US007681412B1

(12) United States Patent
Arroyo et al.

(10) Patent No.: US 7,681,412 B1
(45) Date of Patent: Mar. 23, 2010

(54) BEVERAGE COOLER ON AUTOMOBILE-LIKE FRAME

(76) Inventors: Luis A. Arroyo, 4620 N. Kelso St., Chicago, IL (US) 60630; Lillian A. Arroyo, 4620 N. Kelso St., Chicago, IL (US) 60630

( * ) Notice: Subject to any disclaimer, the term of this patent is extended or adjusted under 35 U.S.C. 154(b) by 450 days.

(21) Appl. No.: 11/800,827

(22) Filed: May 8, 2007

(51) Int. Cl.
*F25D 3/06* (2006.01)

(52) U.S. Cl. ..... 62/457.7; 62/440; 220/592.2; 206/457

(58) Field of Classification Search ..... 280/47.26, 280/35, 47.18, 641; 62/457.7; 40/591, 611.08
See application file for complete search history.

(56) References Cited

U.S. PATENT DOCUMENTS

| | | | | | |
|---|---|---|---|---|---|
| 1,327,552 | A | * | 1/1920 | Hanson | 40/606.04 |
| 3,775,926 | A | * | 12/1973 | Brown et al. | 52/718.02 |
| 4,541,208 | A | * | 9/1985 | Vesperman et al. | 52/19 |
| 4,838,004 | A | * | 6/1989 | Adell | 52/716.6 |
| D311,300 | S | | 10/1990 | Anderson | |
| 5,221,119 | A | * | 6/1993 | Emery | 296/39.2 |
| 5,228,706 | A | * | 7/1993 | Boville | 280/43.22 |
| 5,395,011 | A | | 3/1995 | Kennedy | |
| 5,407,218 | A | * | 4/1995 | Jackson | 280/30 |
| 5,688,569 | A | * | 11/1997 | Gilmore et al. | 428/31 |
| 6,094,936 | A | | 8/2000 | Miller | |
| 6,497,018 | B1 | * | 12/2002 | Chiu et al. | 27/2 |
| 7,147,125 | B1 | * | 12/2006 | Slovak et al. | 220/592.2 |
| 2003/0168371 | A1 | * | 9/2003 | Weimer | 206/457 |
| 2005/0230936 | A1 | * | 10/2005 | Van Horn et al. | 280/641 |
| 2006/0237925 | A1 | * | 10/2006 | Vanderberg et al. | 280/35 |
| 2009/0008951 | A1 | * | 1/2009 | Whetstine et al. | 293/120 |

FOREIGN PATENT DOCUMENTS

| | | | |
|---|---|---|---|
| GB | 2150727 | A * | 7/1985 |

* cited by examiner

*Primary Examiner*—Paul N Dickson
*Assistant Examiner*—Brodie Follman
(74) *Attorney, Agent, or Firm*—Philip H. Kier

(57) ABSTRACT

A portable beverage cooler contained in a box with tracks that accept rails attached to panels with decorative automobile designs. Panels with the design of one automobile mobile can readily be replaced by panels with the design of another model. Attached the box axles with wheels so that the beverage cooler can readily be moved from place to place.

9 Claims, 4 Drawing Sheets

BEVERAGE COOLER ON AUTOMOBILE-LIKE FRAME

BACKGROUND OF THE INVENTION

This invention pertains to a portable beverage cooler. More particularly, it pertains to a portable beverage cooler contained within a simulated automobile frame.

Most beverage coolers are comprised of an insulated box with a cover and handles for carrying attached to the box. However, there are occasional beverage coolers that are more decorative. An example is the combination bottled beverage container and miniature golf cart taught by Miller in U.S. Pat. No. 6,094,936. The instant invention has a box with an insulated compartment for the storing and/or cooling containers of beverages. The instant invention is a decorative beverage cooler wherein the cooler itself is contained with a miniature automobile.

SUMMARY OF THE INVENTION

The instant invention has a box with an insulated compartment and possibly other compartments where other things may be kept. The box has a lid with longitudinal tracks. Each lateral side of the box has two tracks extending from the front to the back of the box. Attachable to the lid's tracks is a panel representing the top of an automobile (or truck, or three-wheeled motorcycle) from the hood to the cabin and the trunk. This top panel has rails that can be slid into the tracks on the lid. There are also two side panels, representing the side fenders of the car, each with rails that can be slid into the tracks on the sides of the box. There is also a front panel representing the grille and headlights of an automobile and a rear panel represent the rear that attach to the tracks on the side panels. These panels are not permanently attached to the box, but rather can be readily removed so that the user replace them with panels representing a different model of car.

BRIEF DESCRIPTION OF THE SEVERAL VIEWS

Figure 1A:
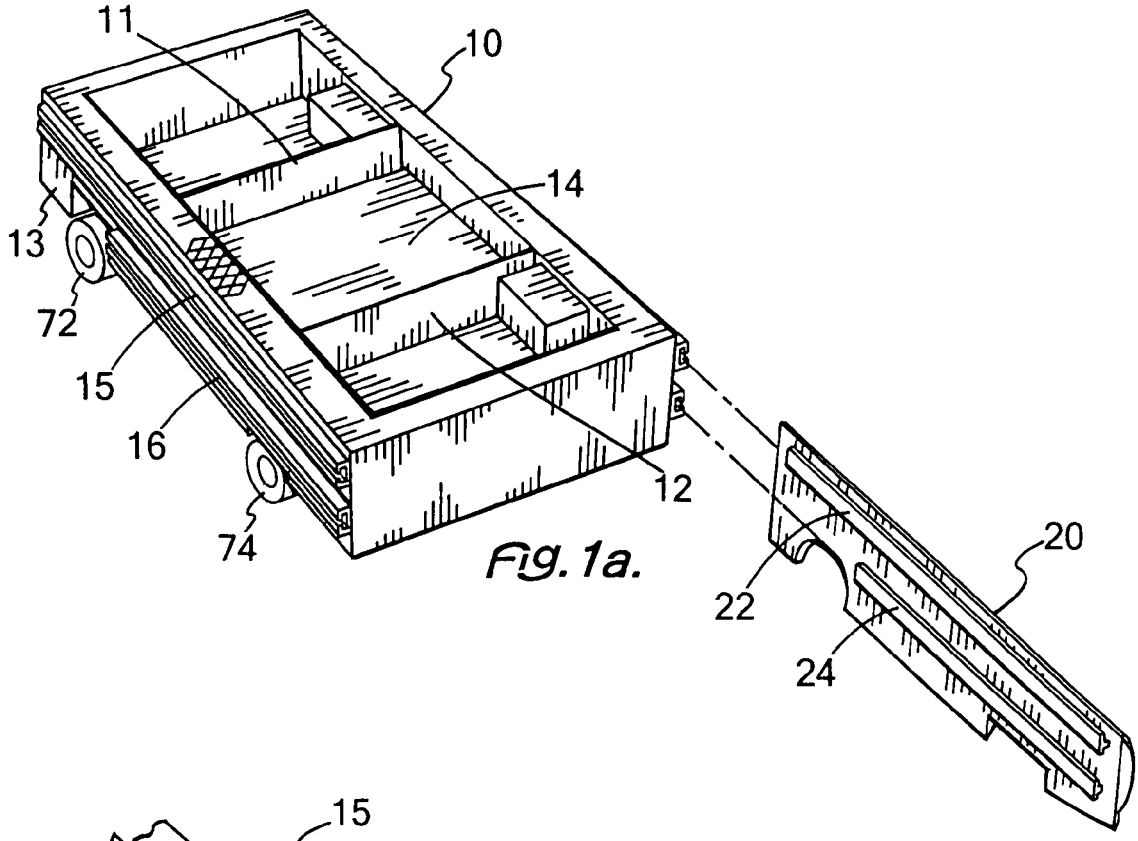

FIG. 1*a* is a view of the cooler box and a side panel.

Figure 1B:
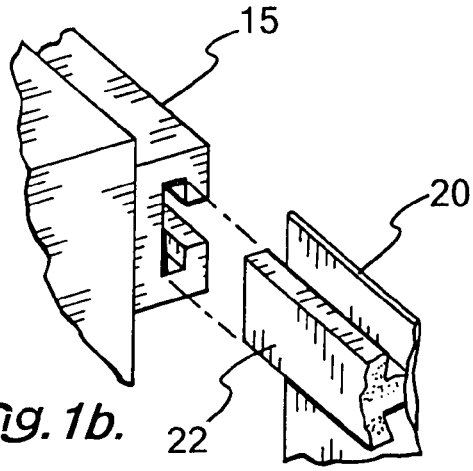

FIG. 1*b* is a view of mating of a track on a side of the cooler box and a rail on a side panel.

Figure 2A:
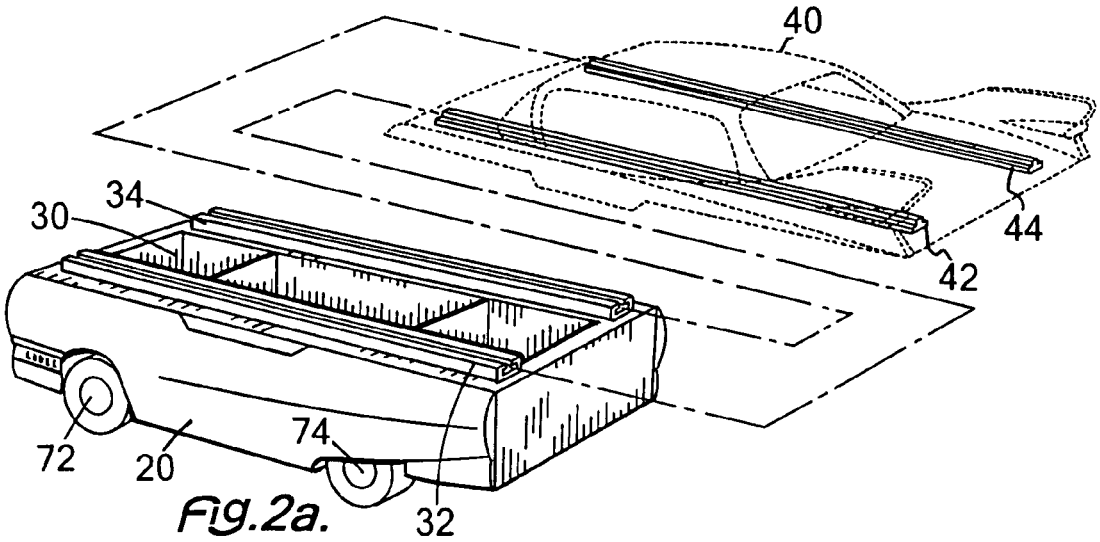

FIG. 2*a* shows a disassembled view of the cooler box, lid, and top panel.

Figure 2B:
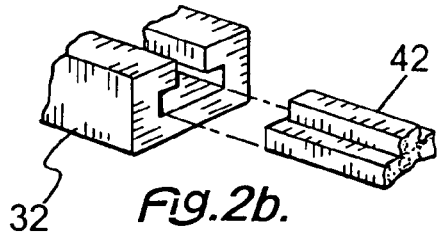

FIG. 2*b* shows mating between a track on the lid and a rail on the top panel.

Figure 3:
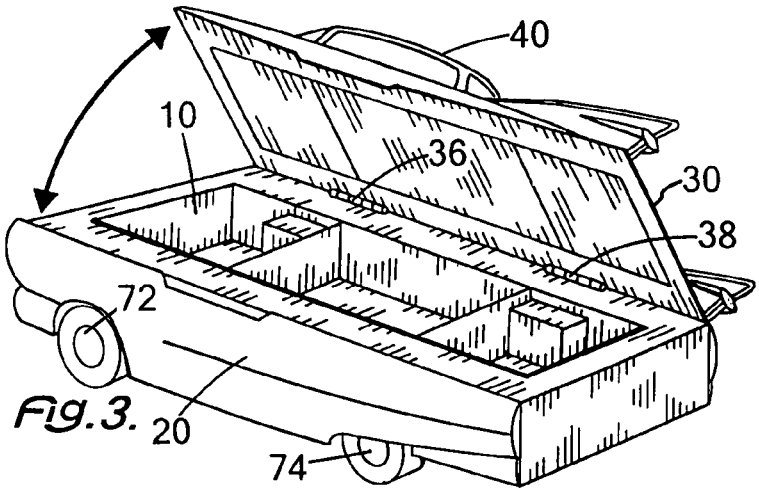

FIG. 3 shows a view of the cooler box with the lid attached and a top panel attached to the lid.

Figure 4A:
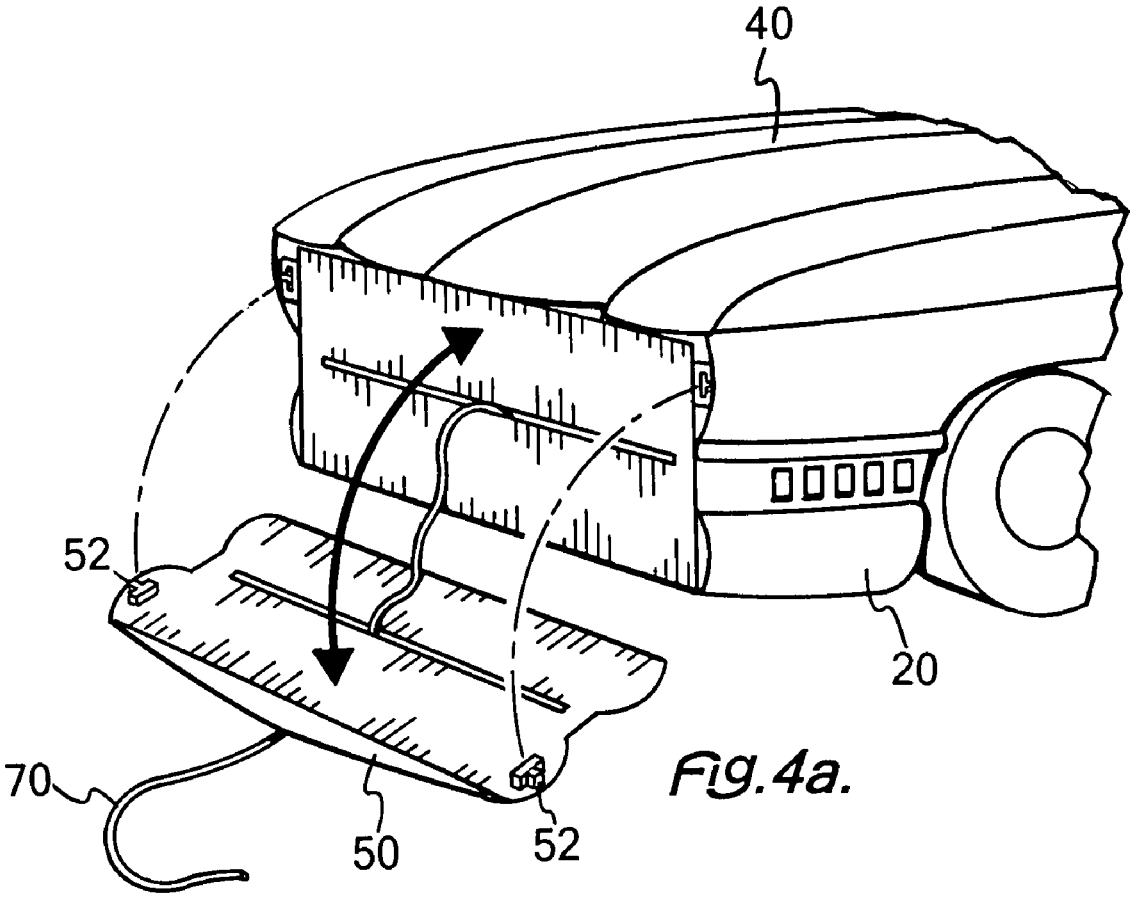

FIG. 4*a* shows a front panel, a top panel, and a side panel.

Figure 4B:
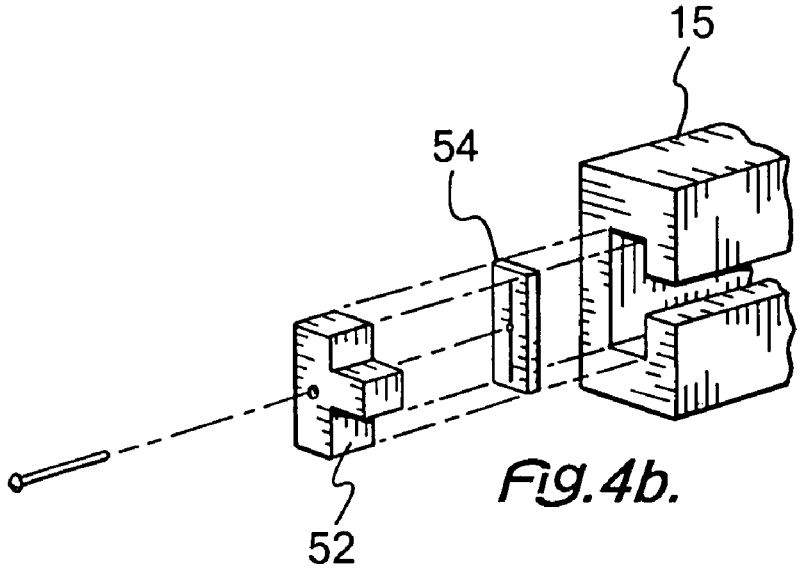

FIG. 4*b* shows the mating between the front panel and a track on a side of the cooler box.

Figure 5A:
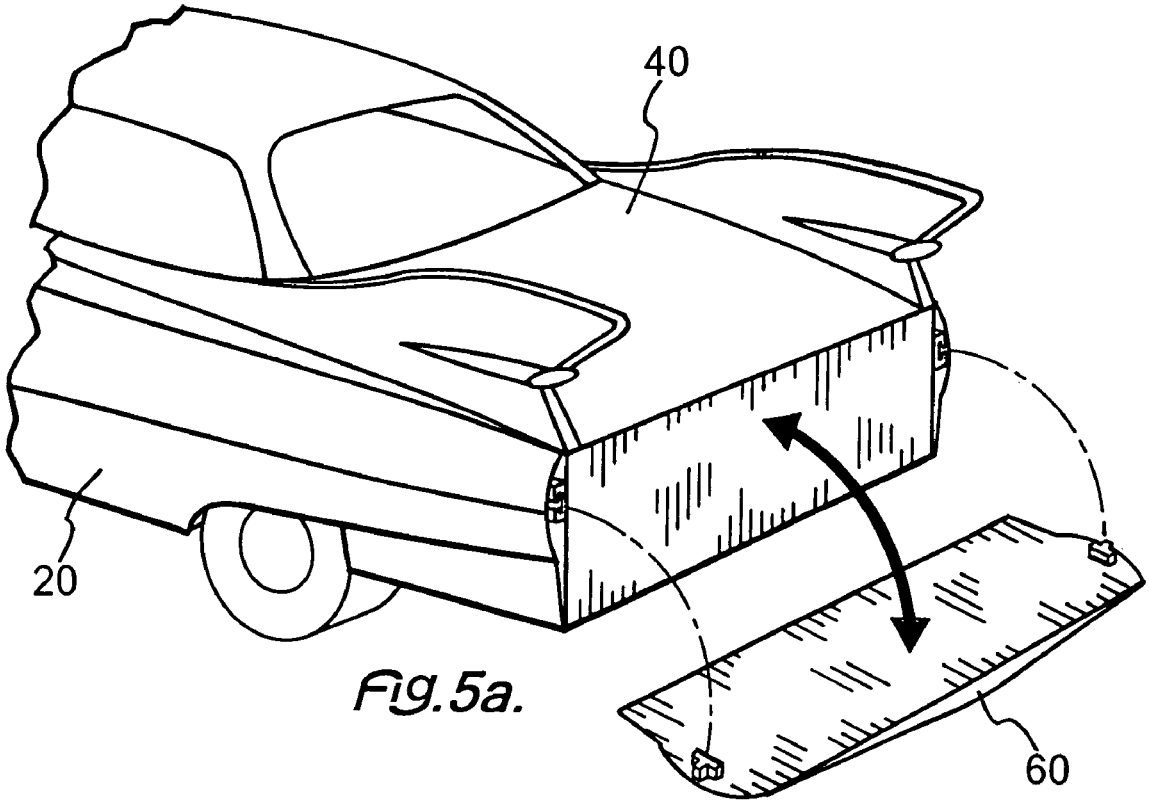

FIG. 5*a* shows a back panel, a top panel, and a side panel.

Figure 5B:
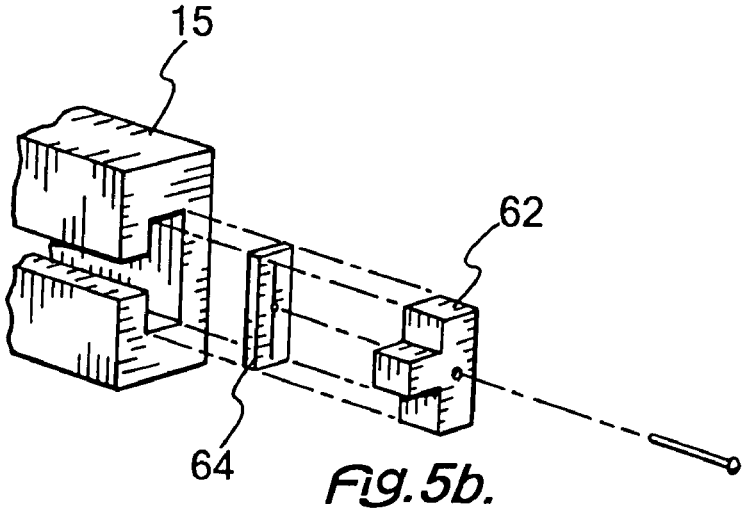

FIG. 5*b* shows the mating between the back panel and a track on a side of the cooler box.

DETAILED DESCRIPTION OF THE INVENTION

FIG. 1*a* shows a box 10 divided by interior walls 11 and 12 into three compartments. Although this figure shows three compartments, there can any small number of compartments so long at the walls abutting the beverage cooler compartment 14, including the side walls of the box, are insulated. The side walls 13 of the box have horizontal tracks. It is preferred that there are two side tracks, upper track 15 and lower track 16. These may have any shape that is compatible for mating with rails 22 and 24 permanently attached to a side panel 20 shown in FIG. 1*a*. In the embodiment shown, the tracks have a block-C-shaped cross section and the rails have T-shaped cross section as shown in FIG. 1*b*. It is preferred that track 15 extend the length of box. Because a side panel represents the side of an automobile, which has wheel holes, it is adequate for track 16 to extend only between the wheel holes.

As shown in FIG. 2*a*, box 10 also has a lid 30, which should be insulated above the beverage cooler compartment. Tracks 32 and 34 extend the length of the top of the lid adjacent to the lateral edges. As shown in FIGS. 2*a* and 2*b*, these tracks mate with rails 42 and 44 on top panel 40, which represents the top of an automobile (or truck) from the hood to the cabin and the trunk. The lid may be attached to the box by means of hinges 36 and 38 as shown in FIG. 3. The invention also has a front panel 50 that represents the grille and headlights of an automobile. Attached to the front panel are stubbly rails 52 that mate with the front end of upper tracks 15 on the side walls as shown in FIGS. 4*a*-4*b*. Front panel rails 52 may be attached to an insert 54 that fits into upper track 15. Similarly, the invention had a back panel 60 that represents the rear of an automobile. Attached to the back panel are stubbly rails 62 that mate with the back end of upper track 15 on the side walls as shown in FIGS. 5*a*-5*b*. Back panel rails 62 may be attached to an insert 64 that fits into upper track 15.

In keeping with the invention being portable and having decorative exterior panels simulating automobiles, it should have wheels so that it can be transported from place to place without always being lifted. Two pairs of wheels 72 and 74 can be attached to axles that are attached to the box 10. There may also be a means of pulling the invention. This could be a rope or chain 70 that is attached to an axle or the front of the box and is threaded through a grille in front panel 50.

The invention is easy to assemble, and may have panels representing a variety of automobile models. Starting with the basic box 10 containing the beverage cooler 14, with wheels and axles attached, rails 22 and 24, are slid into tracks 15 and 16 on side walls 13. Then insert 54 and 64 are plugged into the front and back of tracks 15, respectively. Then stubby front rails 52 are placed in track 15 adjacent to insert 54 to attach front panel 50 to the box and stubby back rails 62 are placed in track 15 adjacent to insert 64 to attach back panel 60 to the box. After the front panel is attached, rope 70 could be threaded through a grille in it. Inserts 54 and 64 are not essential components. However, if present, and if rails 52 and 62 are screwed to them, the front panel and the back panel would be attached more firmly to the box. Then rails 42 and 44 on top panel 40 are slid into tracks 32 and 34 on lid 30. Then the lid could be opened and beverage containers, as possibly ice or other cooling substances could be placed in beverage compartment 14. The invention with panels for one model automobile could be dissembled by reversing this process. The invention should be sized so that it could be fit into the trunk of an automobile for use at a picnic, a beach, or another remote location.

The invention claimed is:

1. A portable beverage cooler comprising:

a box with an isolated compartment, the box having a front wall, two side walls, a back wall, and a movable lid;

a track attached to the front wall, tracks attached to each side wall, a track attached to the back wall, and tracks attached to the lid;

two decorative side panels with rails, the rails being slidable into the tracks of the side walls, the decorative side panels having an automotive theme;

a decorative front panel with short rails slidable into the tracks of the side walls, the decorative front panel having an automotive theme;

a decorative back panel with short rails slidable into the tracks of the side wall, the decorative back panel having an automotive theme; and a decorative top panel with rails slidable into the tracks of the lid, the decorative top panel having an automotive theme.

2. A portable beverage cooler as set forth in claim 1 further comprising two pairs of wheels, each pair of wheels being attached to an axle that is attached to the box, there being a front axle and a rear axle.

3. A portable beverage cooler as set forth in claim 2 wherein the tracks each have a block-C-shaped cross section and each rail has a T-shaped cross section.

4. A portable beverage cooler as set forth in claim 3 wherein the number of tracks on the lid is two and the number of tracks on each side wall is two, an upper and a lower.

5. A portable beverage cooler as set forth in claim 4 wherein the lid is attached to a side wall of the box.

6. A portable beverage cooler as set forth in claim 5 further comprising a flexible elongated pulling means attached to the front axle.

7. A portable beverage cooler as set forth in claim 6 further comprising inserts fitting into the upper side wall track with which the short rails in the front panel and the back panel are attachable.

8. A portable beverage cooler as set forth in claim 6 wherein the flexible pulling means is a rope.

9. A portable beverage cooler as set forth in claim 6 wherein the flexible pulling means is a chain.

* * * * *